United States Patent [19]

White

[11] Patent Number: 4,495,850

[45] Date of Patent: Jan. 29, 1985

[54] AZIMUTH TRANSFER SCHEME FOR A STRAPDOWN INERTIAL MEASUREMENT UNIT

[75] Inventor: Harold V. White, Huntsville, Ala.

[73] Assignee: The United States of America as represented by the Secretary of the Army, Washington, D.C.

[21] Appl. No.: 411,744

[22] Filed: Aug. 26, 1982

[51] Int. Cl.[3] ..... F41G 3/02

[52] U.S. Cl. ..... 89/1.8; 244/3.1

[58] Field of Search ..... 244/3.1; 89/1.8, 1.815

[56] References Cited

U.S. PATENT DOCUMENTS 3,955,468 5/1976 Romilly ..... 89/1.8

4,353,284 10/1982 Billottet et al. ..... 89/1.815

4,444,086 4/1984 White ..... 89/1.8

*Primary Examiner*—Charles T. Jordan

*Attorney, Agent, or Firm*—Anthony T. Lane; Robert P. Gibson; Robert C. Sims

[57] ABSTRACT

The system for aiming of a missile strapdown Inertial Measurement Unit for cases in which the IMU does not possess the capability of self-aiming involves no mechanical link between northfinder and IMU which would require uncoupling prior to launch to avoid expending the northfinder. The technique maintains an automatic, hands-off capability by use of a laser link for azimuth transfer rather than a manual, optical link. The northfinder and laser system are launcher mounted and are therefore not expended with the missile.

6 Claims, 6 Drawing Figures

AZIMUTH TRANSFER SCHEME FOR A STRAPDOWN INERTIAL MEASUREMENT UNIT

DEDICATORY CLAUSE

The invention described herein may be manufactured, used, and licensed by or for the Government for governmental purposes without the payment to me of any royalties thereon.

DESCRIPTION OF THE BEST MODE AND PREFERRED EMBODIMENT

Unless an extremely accurate vertical gyro is utilized, accurate self-contained azimuth alignment of a strapdown Inertial Measurement Unit (IMU) cannot be realized without some form of augmentation such as indexing the IMU, or as a minimum, indexing the vertical gyro through either 90 or 180 degrees for determining short-term gyro drift, i.e., the gyro is calibrated just prior to using it for azimuth heading determination. An extremely accurate vertical gyro or an augmentation technique, in general, adds cost and complexity to a unit which will ultimately be expended.

Figure 1:
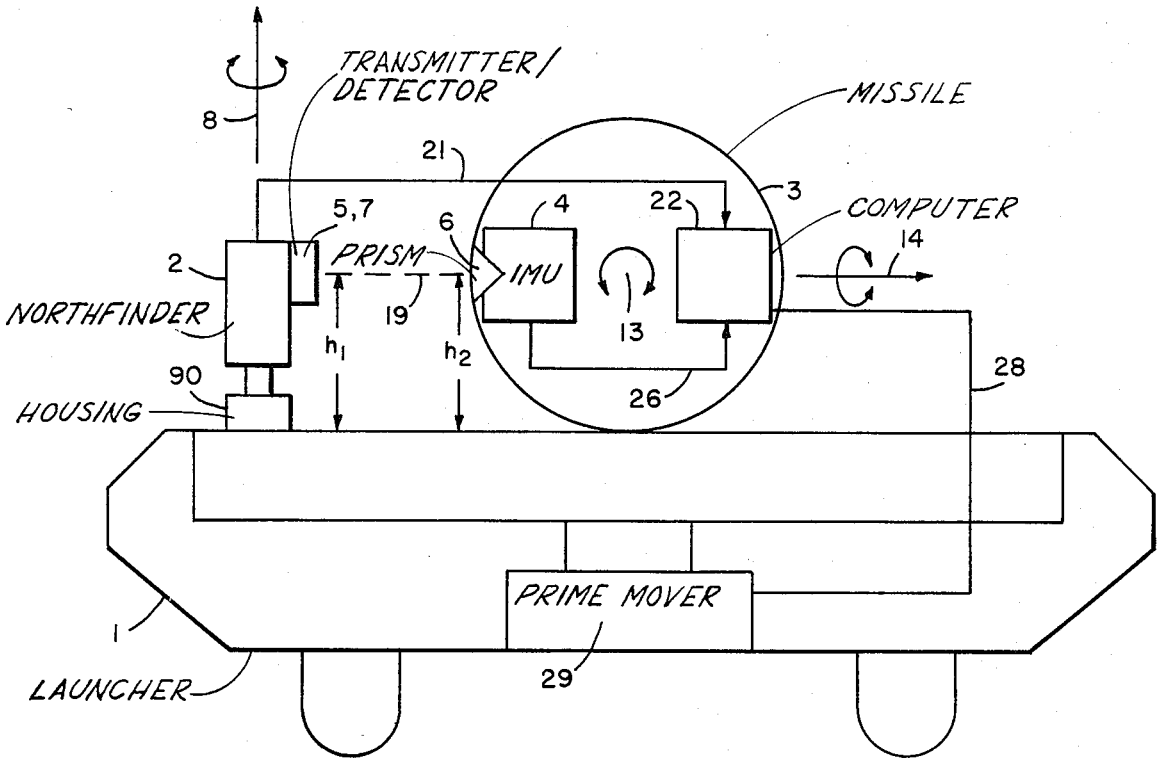
FIG. 1 illustrates an overall view of the present invention.
Figure 2:
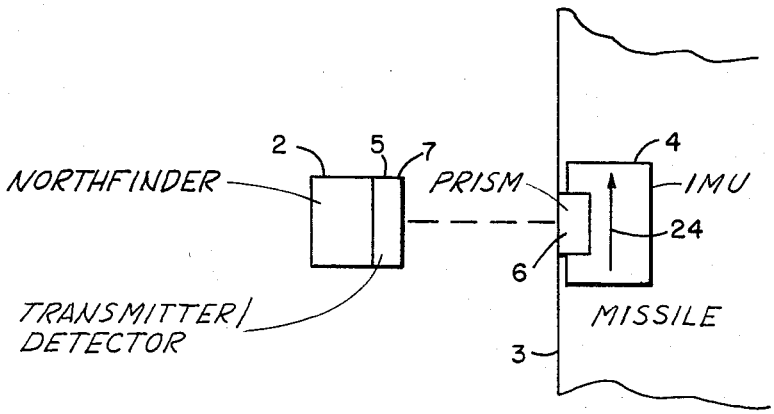
FIG. 2 is a top view of the basic elements of the present invention.
Figure 3:
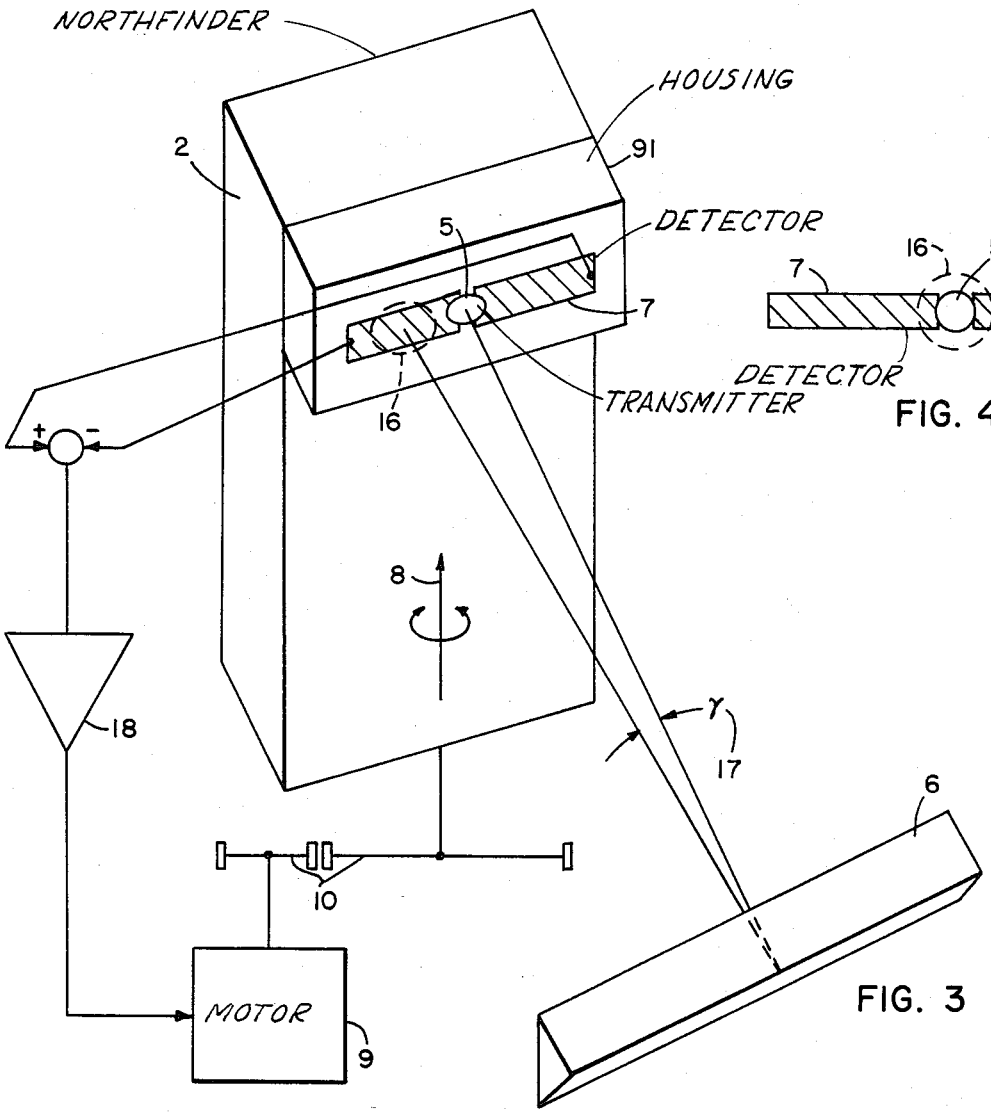
FIG. 3 is a pictorial diagram of the transfer scheme.
Figure 4:
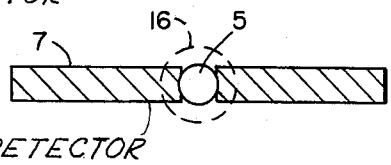
FIG. 4 is a detailed illustration of the detector.
Figure 5:
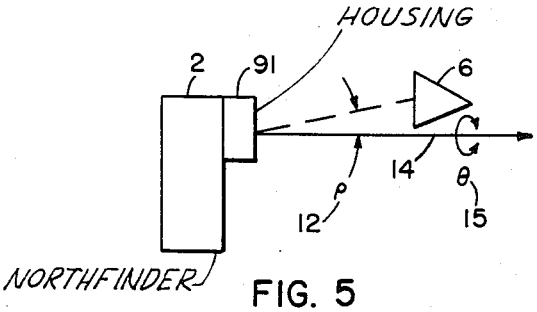
FIG. 5 is an illustration of the condition for look angle error.
Figure 6:
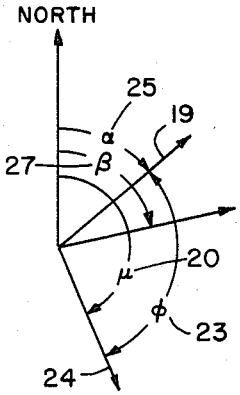
FIG. 6 is an illustration of aiming angles.

This invention (refer to attached FIGS. 1 through 6) is a technique which allows transfer of heading from a launcher 1 mounted, non-expendable northfinder 2 to a missile 3 strapdown IMU 4 by use of a laser diode transmitter 5, prism 6 and beam detector 7. The laser diode 5 and detector 7 are housed in housing 91 with the northfinder 2 whereas the prism 6 is a component of the IMU 4. The northfinder can be any of the well known orientation devices such as a gyrocompass. The prism 6 acts to reflect the beam onto the detector.

The northfinder 2 is driven in a servo loop about the vertical axis 8 by a motor 9 and gear train 10 in housing 90. Orientation of the missile 3 relative to the northfinder 2 must be such that the reflected laser beam 16 can be acquired by the detector 7. This can be accomplished by providing mechanical constraints, fore and aft, about the launcher 1 longitudinal axis (this is normally provided for a mobile missile) and by restricting the allowable angle, $\rho$12, about the roll axis 13 relative to the transmitter 5 and detector 7 system. Additionally, the height $h_1$, of the transmitter 5 and detector 7 must approximate the height, $h_2$ of the prism 6 and tilt about the missle 3 and/or the northfinder 2 pitch axis 14. Unwanted azimuth error, $\epsilon_p$, will accrue with look angle in the following manner:

$$\epsilon_p = \rho \tan \theta$$

in which $\rho$12 is the look angle caused by unequal heights, $h_1$ and $h_2$, and $\theta$15 is the pitch angle of the missle 3 (and therefore of the prism 6 about its non-sensitive axis) and/or the northfinder 2 case.

At the launch site, operation is begun by energizing the laser diode transmitter 5 and detector 7 system. An off-null position of the laser beam 16 reflected onto the detector 7 from the prism 6 (see FIG. 3) will generate an output signal proportional to the angle $\gamma$17 which feeds servo electronics 18 to activate the drive motor 9 and gear train 10. The motor 9 and gear train 10 drive the northfinder 2 about the vertical axis 8 to null the detector 7 output signal. When a null condition is obtained, the gear 10 reduction ratio is such that the line-of-sight 19 established between northfinder 2 and prism 6 is locked when power is removed from the drive motor 9. The northfinder 2 is now ativated and determines the heading, $\mu$20, from north of the line-of-sight 19 previously established and locked between northfinder 2 and prism 6. This information is transmitted via data link 21 to the computer 22 and the transfer is complete. The transferred heading is used in conjunction with other data to complete the assignment process as discussed below.

The constant angle, $\phi$23, between line-of-sight 19 and the input axis 24 of the down range accelerometer is previously determined in an IMU calibration procedure and stored in the computer 22. All elements are therefore available for computation of IMU 4 azimuth heading, $\alpha$25, i.e., the heading of the down range accelerometer input axis 23:

$$\alpha = \mu - \phi$$

in which $\mu$20 has been transferred to the computer via the described technique. Orientation about the two level axes, pitch 14 and roll 13 is accomplished concurrently with azimuth determination and is provided to the computer 22 via data link 26 from IMU 4 accelerometers. Thus IMU 4 initial conditions in azimuth (from northfinder 2) and level (from IMU 4 accelerometers) have been established.

Angle $\beta$27 is the known target heading from north and is also stored in the computer 22. Computed angle $\beta - \alpha$ can be used to rotate the missile 3 to the target azimuth $\beta$27 if desired via data link 28 to launcher prime mover 29. Otherwise $\beta - \alpha$ is used in computer 22 for flight guidance and control.

With IMU 4 initial conditions set, the system is placed in the navigate mode, erected and launched. The transfer scheme may be used repeatedly each time a new round is loaded onto the launcher.

I claim:

1. In a missile launching system having a launcher with a missile mounted thereon; the improvement comprising a northfinder mounted on the launcher separately from the missile; a laser diode transmitter mounted to said northfinder for transmitting a laser beam to said missile while it is located on said launcher; a beam detector mounted about said laser diode transmitter for receiving reflected energy from said laser beam; and a reflector mounted on said missile for receiving said laser beam and reflecting said beam back to said beam detector whereby the relative position of said missile and said northfinder can be determined.

2. A system as set forth in claim 1 further comprising servo electronics for detecting angle errors between the orientation of said beam detector and said reflector on said missile; and said servo electronics causing said northfinder to move such that the angle differences will become zero.

3. A system as set forth in claim 2 further comprising a computer device which determines the orientation of the missile with respect to the information from the orientation of the northfinder and the beam detector; and orientation means being responsive to said computer for causing said missile to be driven in a predetermined direction.

4. A system as set forth in claim 3 wherein said orientation means is a servo device which causes said missile to orient to a proper pointing position on said launcher.

5. A system as set forth in claim 3 wherein said orientation means causes said missile to guide toward a proper trajectory after launching.

6. A system as set forth in claim 3 wherein said reflector is a prism mounted on said missile.

* * * * *